US010506349B2

(12) United States Patent
Komatsu

(10) Patent No.: US 10,506,349 B2
(45) Date of Patent: Dec. 10, 2019

(54) ELECTROACOUSTIC TRANSDUCER, METHOD OF MANUFACTURING ELECTROACOUSTIC TRANSDUCER, AND ELECTROACOUSTIC TRANSDUCING DEVICE

(71) Applicant: Audio-Technica Corporation, Tokyo (JP)

(72) Inventor: Maiko Komatsu, Kanagawa (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 15/895,184

(22) Filed: Feb. 13, 2018

(65) Prior Publication Data

US 2018/0262842 A1 Sep. 13, 2018

(30) Foreign Application Priority Data

Mar. 7, 2017 (JP) ..... 2017-042353

(51) Int. Cl.
*H04R 9/08* (2006.01)
*H04R 7/12* (2006.01)
(Continued)

(52) U.S. Cl.
CPC ..... *H04R 9/08* (2013.01); *H04R 7/127* (2013.01); *H04R 7/18* (2013.01); *H04R 7/22* (2013.01);
(Continued)

(58) Field of Classification Search
CPC . H04R 1/04; H04R 1/02; H04R 31/00; H04R 1/28; H04R 2201/029
(Continued)

(56) References Cited

U.S. PATENT DOCUMENTS 3,115,207 A * 12/1963 Wiggins ..... H04R 1/38 181/158
2005/0135640 A1* 6/2005 Kondo ..... H04R 1/04 381/174

FOREIGN PATENT DOCUMENTS

JP 06-178390 A 6/1994
JP 2011-018953 A 1/2011
JP 2011018953 A * 1/2011

* cited by examiner

*Primary Examiner* — Alexander Jamal
(74) *Attorney, Agent, or Firm* — W&C IP

(57) ABSTRACT

Provided are an electroacoustic transducer in which deterioration and variation in frequency characteristics are suppressed, a method of manufacturing an electroacoustic transducer, and an electroacoustic transducing device. An electroacoustic transducer 3 includes a diaphragm 34, a housing 33 accommodating the diaphragm, an elastic member 37 being accommodated in the housing, and a pressing member 31 pressing the elastic member. The elastic member is annular. The diaphragm includes a dome portions 341 and 342, and an attaching portion 343 disposed on an outer rim of the dome portion. The housing includes a stepped portion 331. The stepped portion includes a mounting surface 331*a* on which the attaching portion is mounted, and a wall surface 331*b* extending in a direction separating from the mounting surface. The elastic member 37 has an inner circumference, and an outer circumference. The pressing member presses the elastic member against the attaching portion. The outer circumference of the elastic member stretches to the wall surface. The inner circumference of the elastic member stretches to a border 344 between the dome portion and the attaching portion.

15 Claims, 17 Drawing Sheets

(51) Int. Cl.

| | |
|---|---|
| ***H04R 9/02*** | (2006.01) |
| ***H04R 7/18*** | (2006.01) |
| ***H04R 7/22*** | (2006.01) |
| *H04R 31/00* | (2006.01) |
| *H04R 1/08* | (2006.01) |
| *H04R 1/28* | (2006.01) |

(52) U.S. Cl.
CPC ..... *H04R 9/025* (2013.01); *H04R 1/08* (2013.01); *H04R 1/2869* (2013.01); *H04R 31/003* (2013.01)

(58) Field of Classification Search
USPC ..... 381/368, 345, 355, 361
See application file for complete search history.

ELECTROACOUSTIC TRANSDUCER, METHOD OF MANUFACTURING ELECTROACOUSTIC TRANSDUCER, AND ELECTROACOUSTIC TRANSDUCING DEVICE

TECHNICAL FIELD

The present invention relates to an electroacoustic transducer, a method of manufacturing an electroacoustic transducer, and an electroacoustic transducing device.

BACKGROUND ART

An electroacoustic transducer that mutually converts an electric signal and a sound wave, is incorporated in an electroacoustic transducing device such as a microphone, a headphone, or a speaker. The electroacoustic transducer generates a sound wave corresponding to an electric signal when a diaphragm vibrates based on the electric signal, or generates an electric signal corresponding to a sound wave when a diaphragm vibrates based on the sound wave.

The conversion types of the electroacoustic transducer include a dynamic type using a magnetic field and a capacitor type using an electric field, etc.

A dynamic-type electroacoustic transducer includes a magnetic circuit, a voice coil, a diaphragm, and a housing. The magnetic circuit generates a magnetic field. The voice coil is a conductor disposed in a magnetic field of the magnetic circuit. The voice coil is attached to the diaphragm. The diaphragm generates a sound wave by being vibrated by a driving force generated by flowing an electric signal (electric current) in the voice coil, and generates an electric signal in the voice coil by vibrating together with the voice coil by receiving a sound wave. The diaphragm includes a vibrating portion and an outer rim portion disposed on an outer rim of the vibrating portion. The outer rim portion of the diaphragm is fixed to (held on) an attaching portion of the housing. The housing accommodates the magnetic circuit, the voice coil, and the diaphragm.

As a method of fixing the outer rim portion of the diaphragm to the housing, there is a method using an adhesive agent (for example, refer to Japanese Published Unexamined Patent Application No. H06-178390).

In the method disclosed in Japanese Published Unexamined Patent Application No. H06-178390, the outer rim portion of the diaphragm is adhered to the attaching portion of the housing by an adhesive agent. Normally, an adhesion margin on the attaching portion is narrow, and it is difficult to uniformly apply an appropriate amount of an adhesive agent to the adhesion margin. Therefore, an individual difference in adhesion occurs on the outer rim portion of the diaphragm. That is, for example, when an amount of the adhesive agent is larger than the appropriate amount, the adhesive agent protrudes into the vibrating portion on the inner side of the outer rim portion of the diaphragm and restricts vibration of the vibrating portion. As a result, the frequency characteristics of the electroacoustic transducer deteriorate. In addition, for example, when the amount of the adhesive agent is smaller than the appropriate amount, a gap is formed between the outer rim portion of the diaphragm and the attaching portion of the housing. As a result, when the vibrating portion vibrates, the outer rim portion of the diaphragm collides with the attaching portion of the housing and causes unevenness in frequency response of the electroacoustic transducer (the frequency characteristics deteriorates). Thus, the electroacoustic transducer in which the outer rim portion of the diaphragm and the attaching portion of the housing are fixed by an adhesive agent tends to cause variations in frequency characteristics.

An electroacoustic transducer in which an outer rim portion of a diaphragm is fixed to a housing without using an adhesive agent has been proposed (for example, refer to Japanese Published Unexamined Patent Application No. 2011-18953).

In an electroacoustic transducer disclosed in Japanese Published Unexamined Patent Application No. 2011-18953, an outer rim portion of a diaphragm is mounted on an attaching portion (mounting surface) of a housing (frame), and fixed to the attaching portion of the housing by an elastic-resin-made gasket that is pressed by a lid (baffle). That is, the diaphragm is sandwiched by the gasket and the mounting surface. As a result, without using an adhesive agent, the outer rim portion of the diaphragm is fixed to the mounting surface of the frame.

SUMMARY OF INVENTION

Technical Problem

In an electroacoustic transducer disclosed in Japanese Published Unexamined Patent Application No. 2011-18953, to increase a vibration area of the diaphragm, a width of a contact surface of the gasket with the diaphragm is set to be smaller than a width of the mounting surface. That is, in the outer rim portion of the diaphragm, a portion on the vibrating portion (inner circumference) side does not come into contact with the gasket. Therefore, when the vibrating portion vibrates, the outer rim portion also vibrates and collides with the mounting surface. As a result, the frequency characteristics of the electroacoustic transducer deteriorate.

In addition, in the electroacoustic transducer disclosed in Japanese Published Unexamined Patent Application No. 2011-18953, a gasket thicker and heavier than the diaphragm is placed on the thin-film-shaped lightweight diaphragm. As described above, in the outer rim portion of the diaphragm, a portion on the vibrating portion side does not come into contact with the gasket. Therefore, when the gasket is placed on the outer rim portion of the diaphragm, in a case where an outer diameter of the diaphragm is smaller than that of the mounting surface, the position of the diaphragm easily changes. As a result, the voice coil attached to the diaphragm may make contact with the magnetic circuit.

An object of the present invention is to solve the problem described above and to provide an electroacoustic transducer in which deterioration and variation in frequency characteristics are suppressed, a method of manufacturing an electroacoustic transducer, and an electroacoustic transducing device.

Solution to Problem

An electroacoustic transducer according to the present invention includes a diaphragm, a housing accommodating the diaphragm, an elastic member being accommodated in the housing, and a pressing member pressing the elastic member. The elastic member is annular. The diaphragm includes a dome portion, and an attaching portion disposed on an outer rim of the dome portion. The housing includes a stepped portion. The stepped portion includes a mounting surface on which the attaching portion is mounted, and a wall surface extending in a direction separating from the mounting surface. The elastic member has an inner circumference, and an outer circumference. The pressing member presses the elastic member against the attaching portion. The outer circumference of the elastic member stretches to the wall surface. The inner circumference of the elastic member stretches to a border between the dome portion and the attaching portion.

Advantageous Effects of Invention

According to the present invention, deterioration and variation in frequency characteristics of an electroacoustic transducer are reduced.

DESCRIPTION OF EMBODIMENTS

Embodiments of an electroacoustic transducer, a method of manufacturing an electroacoustic transducer, and an electroacoustic transducing device according to the present invention will now be described with reference to the attached drawings.

Electroacoustic Transducing Device

First, an electroacoustic transducing device according to the present invention is described by taking a microphone as an example.

Configuration of Electroacoustic Transducing Device

Figure 1:
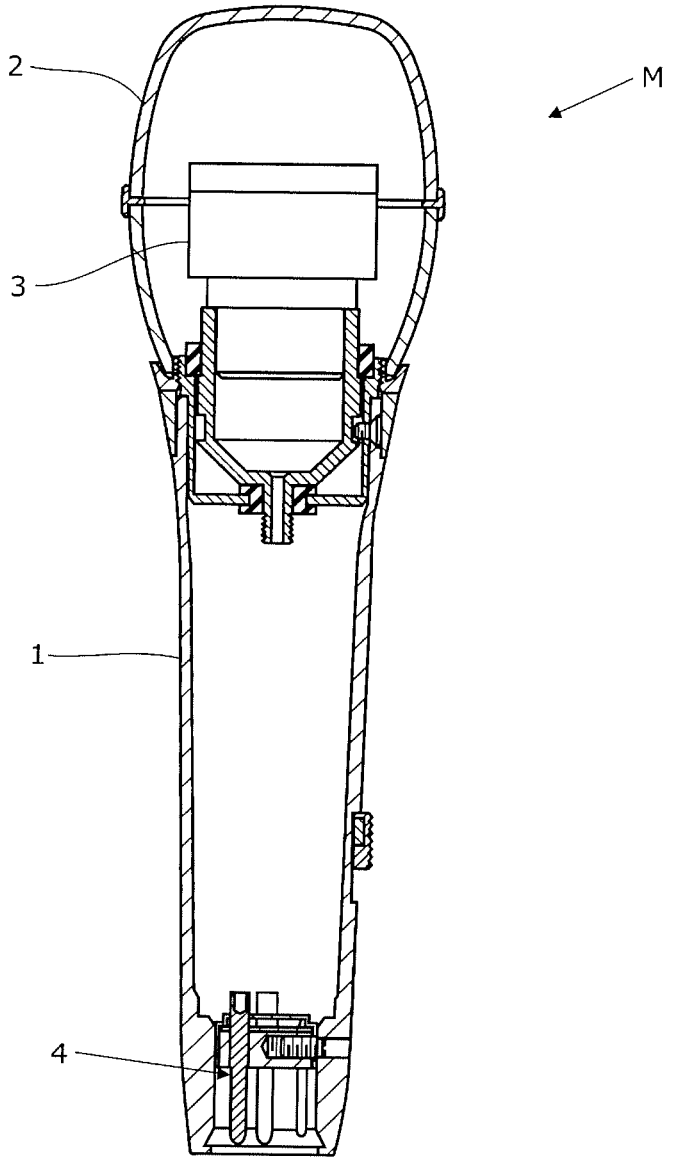
FIG. 1 is a sectional view showing an embodiment of an electroacoustic transducing device according to the present invention.

FIG. 1 is a sectional view showing an embodiment of an electroacoustic transducing device (microphone) according to the present invention. This drawing shows a section of a microphone, taken along a longitudinal direction of the microphone.

In the description below, the front side is a side (the upper side of the paper of FIG. 1) of the microphone which is directed toward a sound source when picking-up sound. The rear side is the opposite side (the lower side of the paper of FIG. 1) of the front side.

A microphone M picks-up a sound wave from a sound source (not shown). The microphone M includes a grip housing 1, a head case 2, an electroacoustic transducer 3, and an output connector 4.

The grip housing 1 functions as a grip of the microphone M. The grip housing 1 is made of, for example, a metal such as brass. The grip housing 1 has a cylindrical shape opened in the front-rear direction.

The head case 2 accommodates the electroacoustic transducer 3 and protects it from dust and wind, etc. The head case 2 is attached to a front end of the grip housing 1.

The electroacoustic transducer 3 is accommodated in a front end portion of the grip housing 1 and the head case 2. Details of the electroacoustic transducer 3 are described below.

The output connector 4 is, for example, an output connector conforming to JEITA Standard RC-5236 "Circular Connectors, Latch Lock Type for Audio Equipment." The output connector 4 is accommodated in a rear end portion of the grip housing 1.

Here, the electroacoustic transducing device according to the present embodiment is the microphone M that picks up a sound wave. Instead of this, the electroacoustic transducing device according to the present invention may be a headphone, a speaker, or an earphone that outputs a sound wave corresponding to an electric signal.

Electroacoustic Transducer (1)

Next, an electroacoustic transducer according to the present invention is described by taking a dynamic-type microphone unit as an example.

Configuration of Electroacoustic Transducer (1)

Figure 2:
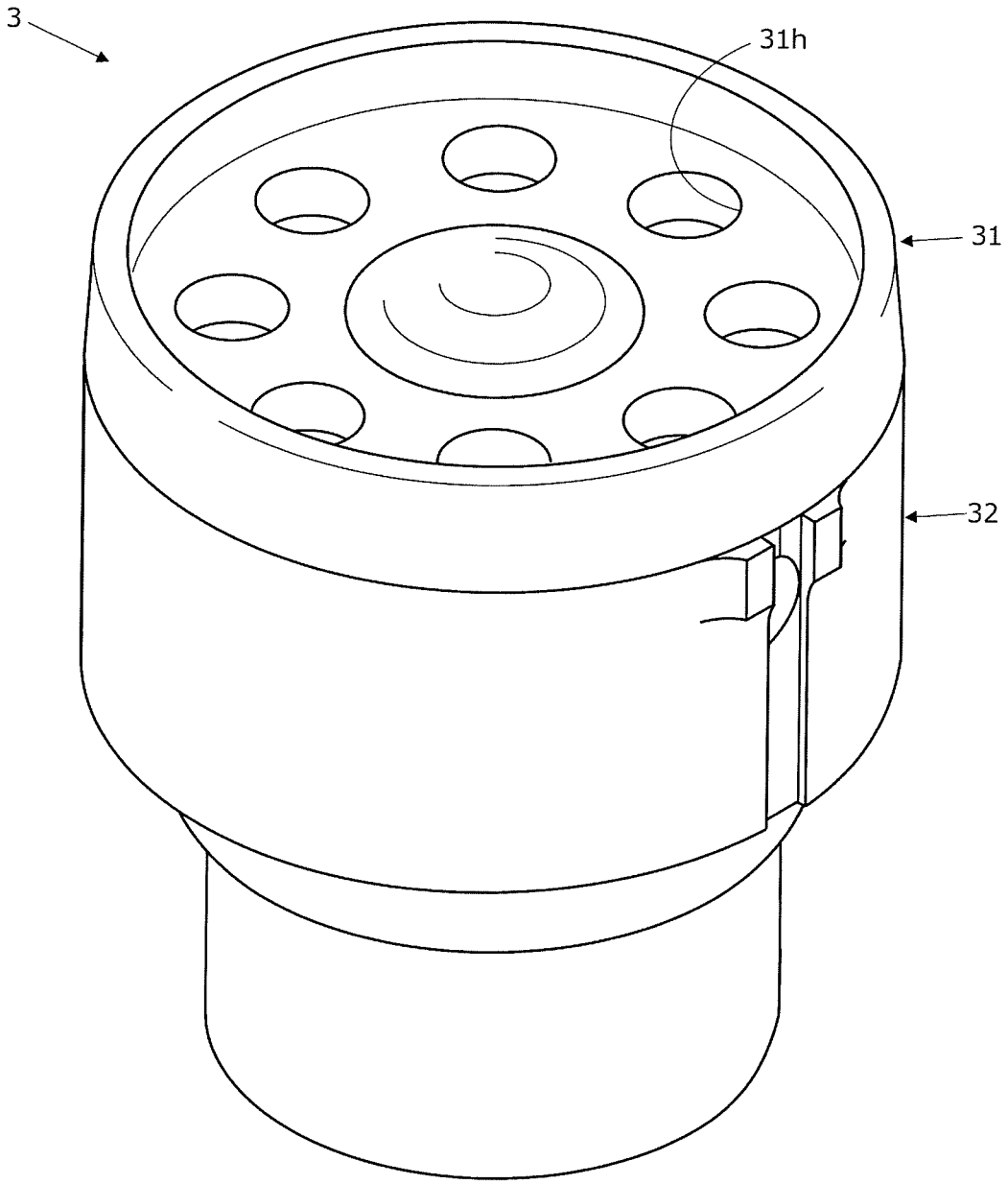
FIG. 2 is a perspective view showing an embodiment of an electroacoustic transducer according to the present invention.

FIG. 2 is a perspective view showing an embodiment of an electroacoustic transducer (microphone unit) according to the present invention.

The electroacoustic transducer 3 converts a sound wave from a sound source into an electric signal. The electroacoustic transducer 3 is, as described above, a dynamic-type microphone unit. The electroacoustic transducer 3 includes a lid portion 31 and a main body portion 32.

Figure 3:
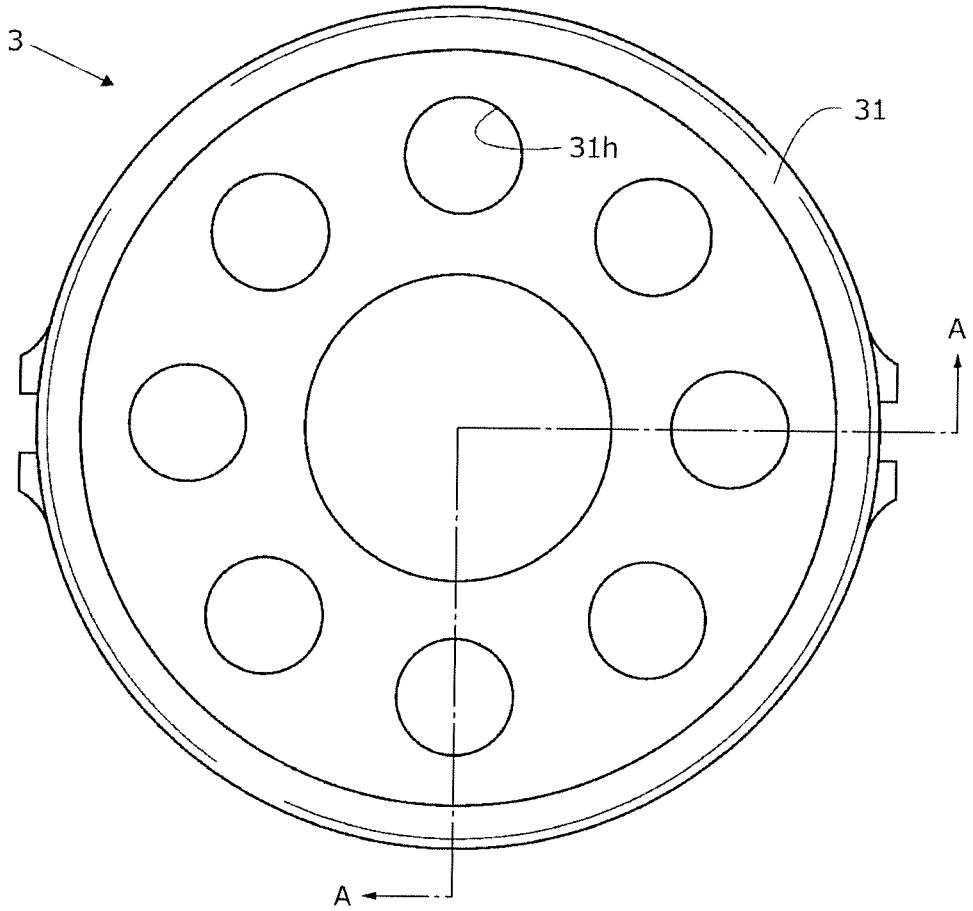
FIG. 3 is a plan view of the electroacoustic transducer shown in FIG. 2.

FIG. 3 is a plan view of the electroacoustic transducer 3.

Figure 4:
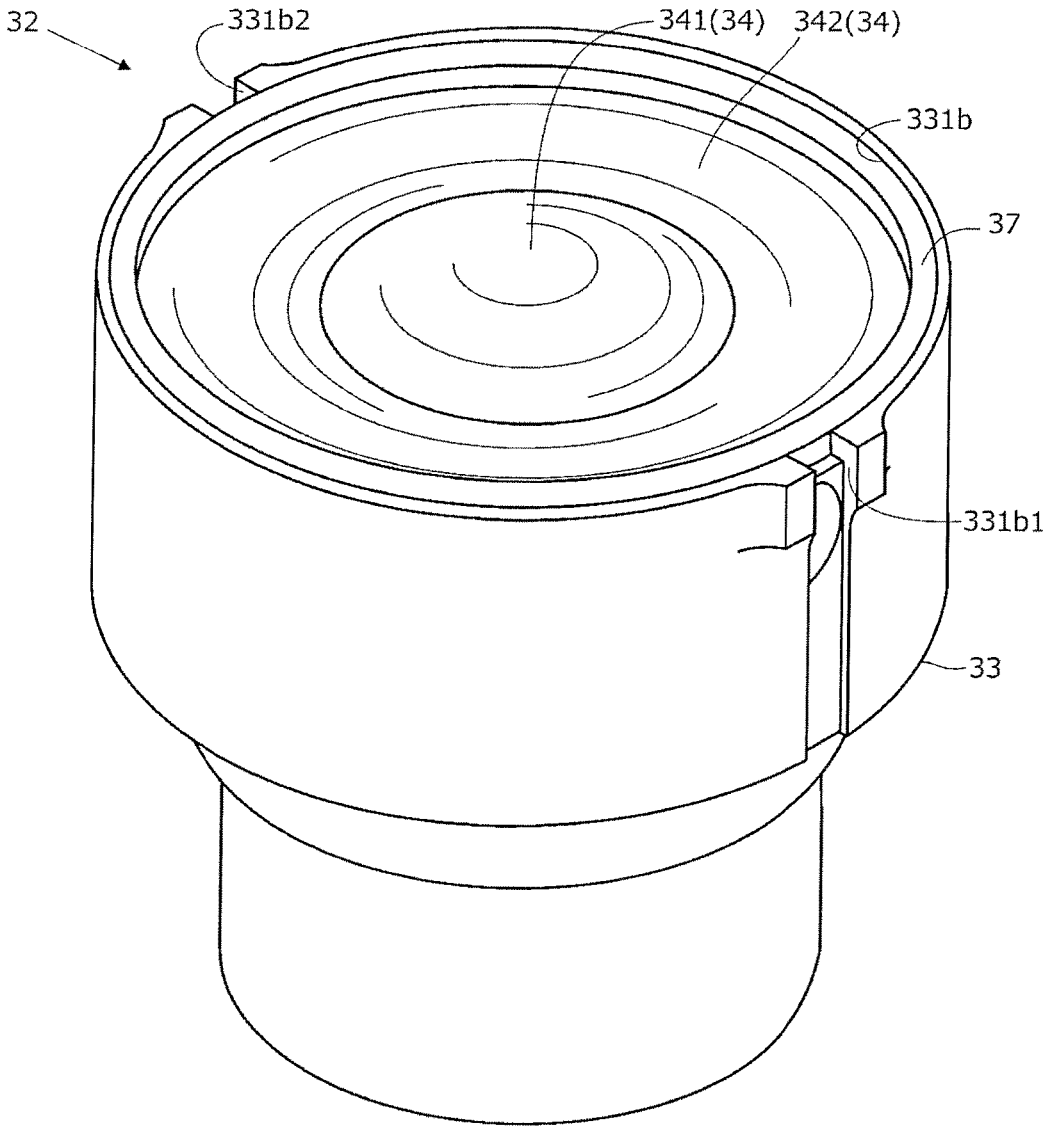
FIG. 4 is a perspective view of a main body portion of the electroacoustic transducer shown in FIG. 2.

FIG. 4 is a perspective view of the main body portion 32.

The lid portion 31 has a shape of a hollow cylinder with an open end and a closed end. The lid portion 31 includes a plurality of front sound holes 31*h*. Details of the lid portion 31 are described below.

The front sound holes 31*h* guide a sound wave from a sound source to the inside of the main body portion 32. The plurality of front sound holes 31*h* are disposed in a bottom portion of the lid portion 31 at even intervals in the circumferential direction of the lid portion 31. The front sound holes 31*h* penetrate through the bottom portion of the lid portion 31 in the front-rear direction (direction orthogonal to the paper of FIG. 3).

The main body portion 32 constitutes a conversion portion (portion to convert a sound wave into an electric signal) of the electroacoustic transducer 3.

Figure 5:
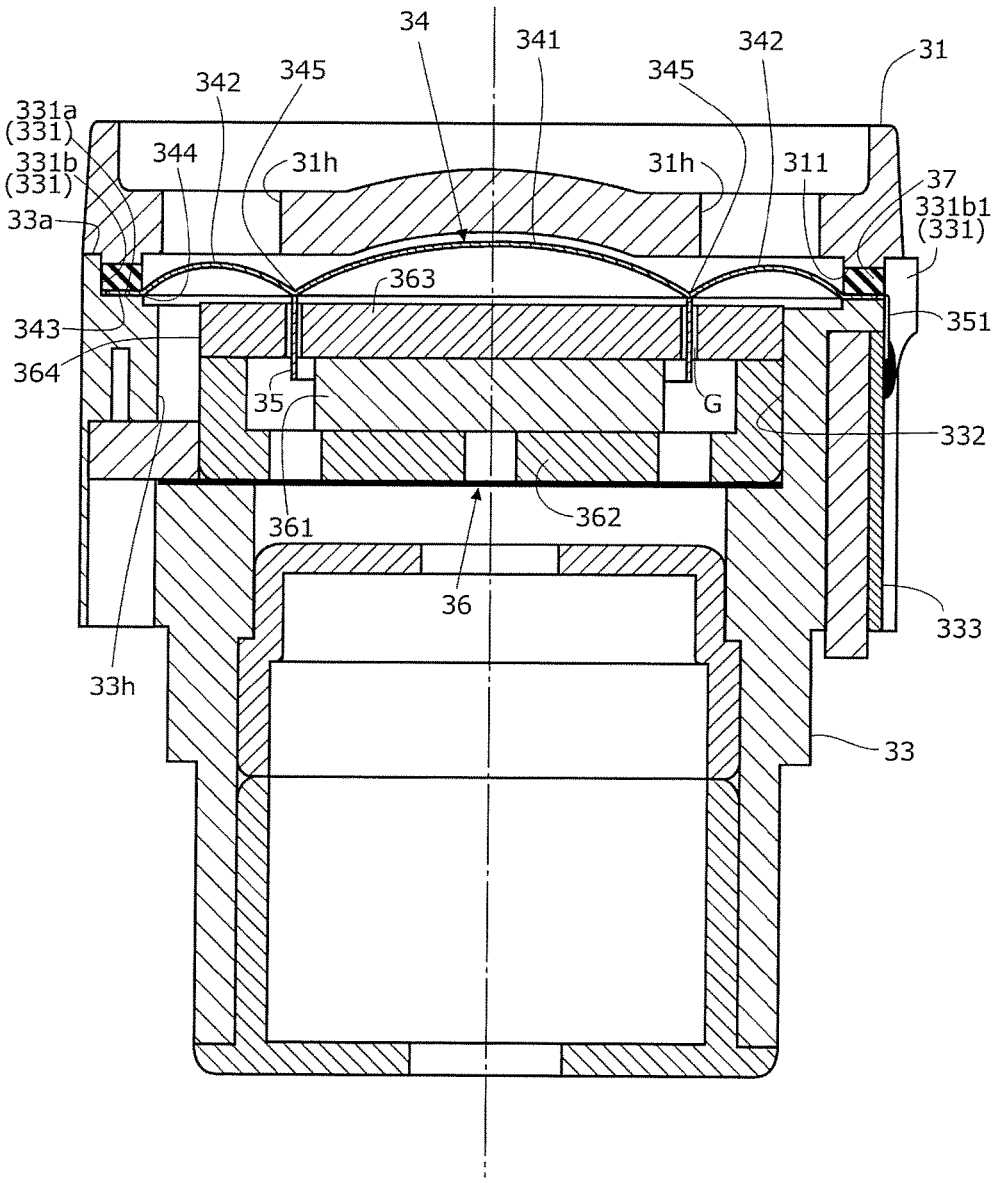
FIG. 5 is a sectional view taken along line AA in the electroacoustic transducer shown in FIG. 3.

FIG. 5 is a sectional view taken along line AA in the electroacoustic transducer 3 shown in FIG. 3.

Figure 6:
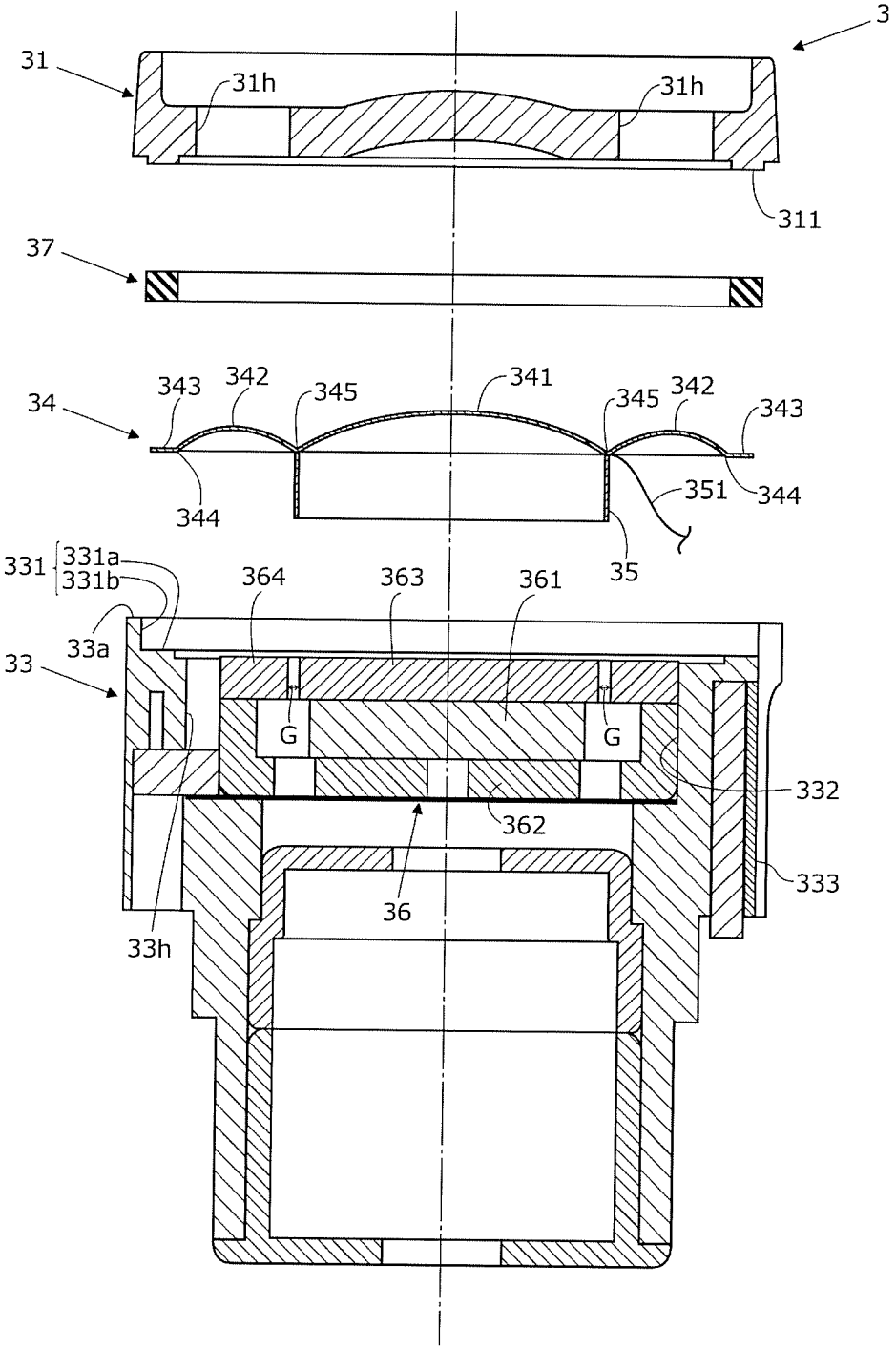
FIG. 6 is an exploded sectional view of the electroacoustic transducer shown in FIG. 5.

FIG. 6 is an exploded sectional view of the electroacoustic transducer 3 shown in FIG. 5.

The main body portion 32 includes a housing 33, a diaphragm 34, a voice coil 35, a magnetic circuit 36, and an elastic member 37.

The housing 33 accommodates the diaphragm 34, the voice coil 35, the magnetic circuit 36, and the elastic member 37. The housing 33 has a substantially cylindrical shape opened in the front-rear direction (the vertical direction of the paper of FIG. 5). The housing 33 is made of, for example, a synthetic resin. The housing 33 includes a stepped portion 331, a magnetic circuit accommodating portion 332, an electrode portion 333, another electrode portion (not shown), a front end face 33*a*, and a plurality of rear sound holes 33*h*.

The stepped portion 331 holds the diaphragm 34 and the elastic member 37. The stepped portion 331 is disposed on an inner circumferential surface of the front end portion of the housing 33 (an opening end of a front portion of the housing 33). That is, the stepped portion 331 has a ring shape (annular in shape). The stepped portion 331 includes a mounting surface 331*a* and a wall surface 331*b*.

The mounting surface 331*a* holds an attaching portion 343 described below of the diaphragm 34. The mounting surface 331*a* is a ring-shaped surface that is positioned on the rear side relative to the front end face 33*a* of the housing 33 and faces forward.

The wall surface 331*b* holds the elastic member 37. The wall surface 331*b* is a tubular wall surface extending in a direction separating forward from the mounting surface 331*a*. That is, the wall surface 331*b* is a surface that is joined to the front end face 33*a* and the mounting surface 331*a* of the housing 33. The wall surface 331*b* includes a slit portion 331*b*1 and a slit portion 331*b*2 (refer to FIG. 4).

The magnetic circuit accommodating portion 332 accommodates the magnetic circuit 36. The magnetic circuit accommodating portion 332 is disposed at the rear of the stepped portion 331 in the housing 33.

The electrode portion 333 and another electrode portion not shown in the drawings electrically connect a lead wire 351 described below of the voice coil 35 and a cable (not shown) to be connected to the output connector 4 (refer to FIG. 1). These two electrode portions are attached to positions opposed to each other on the outer circumferential surface of the housing 33.

The rear sound holes 33*h* guide a sound wave from a sound source to the inside of the housing 33. The rear sound holes 33*h* are disposed at a rim of the magnetic circuit accommodating portion 332.

The diaphragm 34 vibrates by receiving a sound wave from a sound source (due to a pressure difference of the sound wave). The diaphragm 34 is a thin film being circular in a planar view. The diaphragm 34 is made of, for example, a synthetic resin such as polypropylene or polyethylene film. The diaphragm 34 consists of a main dome 341, a sub dome 342, and an attaching portion 343. The main dome 341, the sub dome 342, and the attaching portion 343 are integrally formed on hot pressing. As a result, the diaphragm 34 has a border 344 between the sub dome 342 and the attaching portion 343, and a border 345 between the main dome 341 and the sub dome 342.

The main dome 341 and the sub dome 342 constitute a vibrating portion that vibrates by receiving a sound wave from a sound source. The vibrating portion is a dome portion in the present invention. The main dome 341 has a circular in a planar view, and a dome shape convex forward in a sectional view. The sub dome 342 has a ring shape in a planar view, and an arc shape convex forward in a sectional view. The sub dome 342 is continued to an outer rim of the main dome 341. That is, the sub dome 342 is disposed on an outer rim of the main dome 341.

The attaching portion 343 attaches the vibrating portion to the inside of the housing 33. The attaching portion 343 has a ring shape in a planar view, and a tabular shape in a sectional view. An outer diameter of the attaching portion 343 is smaller than an inner diameter of the wall surface 331*b* of the stepped portion 331. The attaching portion 343 is continued to an outer rim of the sub dome 342. That is, the attaching portion 343 is disposed at the outer rim of the sub dome 342. A line connecting the border 344 between the sub dome 342 and the attaching portion 343 is circular in a planar view.

An outer diameter of the attaching portion may be equal to an inner diameter of the wall surface of the stepped portion.

The voice coil 35 is a conductor that vibrates in the front-rear direction inside a magnetic field generated by the magnetic circuit 36 with vibration of the diaphragm 34. That is, when the voice coil 35 vibrates in a magnetic field, due to interaction of the voice coil 35 and the magnetic field (magnetic flux) of the magnetic circuit 36, an electric current (electric signal) is generated in the voice coil 35. The voice coil 35 has a cylindrical shape. The voice coil 35 is attached to the border 345 between the main dome 341 and the sub dome 342 on a rear surface of the diaphragm 34. The voice coil 35 includes a lead wire (lead-out wire) 351 and another lead wire (not shown). That is, the voice coil 35 includes two positive and negative lead wires.

The lead wire 351 and another lead wire not shown in the drawings transmit an electric signal generated in the voice coil 35 to the electrode portion 333 and the electrode portion not shown in the drawings of the housing 33.

The magnetic circuit 36 generates a magnetic field. The magnetic circuit 36 includes a permanent magnet 361, a yoke 362, a center pole 363, and a ring yoke 364.

The permanent magnet 361 is a source of generation of a magnetic field in the magnetic circuit 36. The permanent magnet 361 is discoid. The yoke 362, the center pole 363, and the ring yoke 364 are magnetic bodies constituting a portion of a path of a magnetic flux from the permanent magnet 361. The yoke 362 has a shape of a hollow cylinder with an open end and a closed end. The center pole 363 is discoid. The ring yoke 364 has a ring shape.

The permanent magnet 361 is disposed on a central front surface of the yoke 362. The center pole 363 is disposed on a front surface of the permanent magnet 361. The ring yoke 364 is disposed on an opening end face of the yoke 362. Between the center pole 363 and the ring yoke 364, a ring-shaped gap (magnetic gap) G is formed.

The elastic member 37 fixes the diaphragm 34 to the housing 33. The elastic member 37 is made of, for example, a synthetic resin with elasticity such as rubber. The elastic member 37 is ring-shaped (annular in shape), and rectangular in a sectional view. That is, the elastic member 37 has an inner circumference and an outer circumference. An upper surface of the elastic member 37 is a to-be-pressed surface to be pressed against the lid portion 31. That is, the elastic member 37 has a to-be-pressed surface.

An outer diameter of the elastic member 37 is slightly smaller than an inner diameter of the wall surface 331*b* of the housing 33. An inner diameter of the elastic member 37 is slightly larger than an outer diameter of the sub dome 342 (an inner diameter of the attaching portion 343) of the diaphragm 34. That is, in a direction orthogonal to the front-rear direction (for example, a radial direction of the elastic member 37 (the horizontal direction of the paper of FIG. 5)), a width of the elastic member 37 is smaller than a width of the mounting surface 331*a* of the stepped portion 331. In the front-rear direction, a thickness of the elastic member 37 is smaller than a length of the wall surface 331*b* of the stepped portion 331.

The lid portion 31 protects the diaphragm 34 from dust, etc., and presses the elastic member 37 and fixes the diaphragm 34 to the housing 33. The lid portion 31 is an example of a pressing member in the present invention.

A portion of the bottom portion of the lid portion 31 projects rearward in a ring shape (annular in shape) and constitutes a pressing projection portion 311. The pressing projection portion 311 presses the elastic member 37. That is, a rear surface of the pressing projection portion 311 is a pressing surface that presses the elastic member 37. That is, the lid portion 31 includes the pressing projection portion 311 and the pressing surface. The pressing projection portion 311 is disposed on an inner side relative to the outer rim of the rear surface of the bottom portion of the lid portion 31 in a radial direction of the lid portion 31. An amount of projection of an inner circumference of the pressing projection portion 311 is the same as an amount of projection of an outer circumference of the pressing projection portion 311.

Method of Manufacturing Electroacoustic Transducer (1)

Next, a method of manufacturing an electroacoustic transducer according to the present invention (hereinafter, referred to as "the present method") is described with reference to FIG. 5 and FIG. 6.

The electroacoustic transducer 3 is manufactured through a first mounting process in which the attaching portion 343 of the diaphragm 34 is mounted on the mounting surface 331*a* of the stepped portion 331, a second mounting process in which the elastic member 37 is mounted on the attaching portion 343, and a pressing process in which the elastic member 37 is pressed against the lid portion 31.

First, the magnetic circuit 36 is accommodated in the magnetic circuit accommodating portion 332 of the housing 33 from the front side of the housing 33. A magnetic gap G of the magnetic circuit 36 is disposed at the rear of the stepped portion 331 in the front-rear direction (the vertical direction of the paper of FIG. 5).

Next, the diaphragm 34 to which the voice coil 35 is attached, that is, the diaphragm 34 and the voice coil 35 are accommodated in the stepped portion 331 of the housing 33 from the front side of the housing 33. The attaching portion 343 of the diaphragm 34 is mounted on the mounting surface 331*a* of the stepped portion 331 (first mounting process). The voice coil 35 is disposed in the magnetic gap G. The two lead wires (the lead wire 351 and the lead wire not shown in the drawings) of the voice coil 35 are wired between the mounting surface 331*a* and the attaching portion 343 and inserted through the slit portions 331*b*1 and 331*b*2 of the housing 33.

Figure 7:
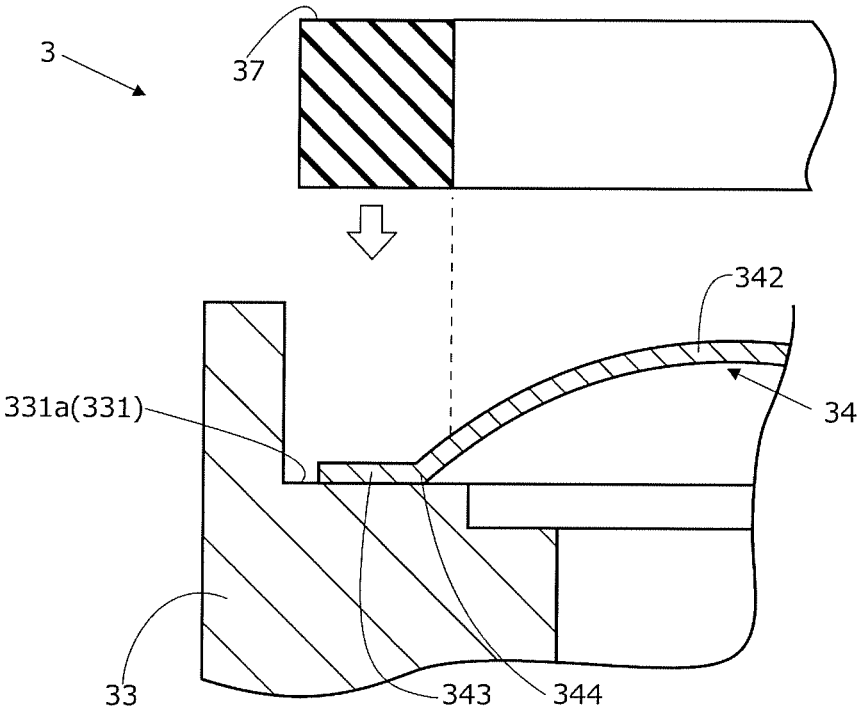
FIG. 7 is a partial enlarged sectional view of an electroacoustic transducer, describing a first mounting process in an embodiment of a method of manufacturing an electroacoustic transducer according to the present invention.

FIG. 7 is a partial enlarged sectional view of the electroacoustic transducer 3, showing a state where the attaching portion 343 of the diaphragm 34 is mounted on the mounting surface 331*a* of the stepped portion 331 through the first mounting process. This drawing shows a state where the position of the diaphragm 34 deviates from a predetermined fixing position when the attaching portion 343 is mounted on the mounting surface 331*a*.

FIG. 5 and FIG. 6 are referred to again.

Next, the elastic member 37 is accommodated in the stepped portion 331 of the housing 33 from the front side of the housing 33. The elastic member 37 is mounted on the attaching portion 343 of the diaphragm 34 (second mounting process). At this time, a portion of an inner circumferential end of a rear surface of the elastic member 37 (a contact surface with the attaching portion 343) makes contact with the sub dome 342 of the diaphragm 34, and the diaphragm 34 is pressed toward a central side (the right side of the paper in FIG. 5) in a radial direction of the housing 33 (the horizontal direction of the paper of FIG. 5) due to the weight of the elastic member 37 itself. That is, the diaphragm 34 is positioned at the central side in the radial direction of the housing 33 by the elastic member 37.

Figure 8:
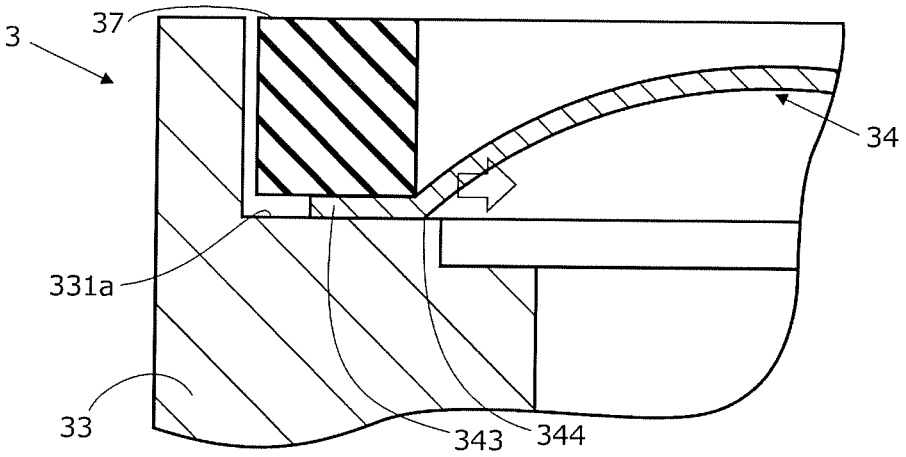
FIG. 8 is a partial enlarged sectional view of the electroacoustic transducer, describing a second mounting process in the embodiment of the method of manufacturing an electroacoustic transducer according to the present invention.

FIG. 8 is a partial enlarged sectional view of the electroacoustic transducer 3, showing a state where the elastic member 37 is mounted on the attaching portion 343 of the diaphragm 34 through the second mounting process. This drawing shows a state where the diaphragm 34 is positioned at the central side (the right side of the paper in FIG. 8) in a radial direction (the horizontal direction of the paper of FIG. 8) of the housing 33 when the elastic member 37 is mounted on the attaching portion 343.

In the first mounting process, when an outer rim of the sub dome is positioned at the inner side of an inner circumferential end of the elastic member, the diaphragm need not be positioned in the second mounting process. That is, for example, in the second mounting process, the elastic member need not be contacted with the sub dome of the diaphragm.

FIG. 5 and FIG. 6 are referred to again.

Next, the lid portion 31 is mounted on the elastic member 37. A rear surface (pressing surface) of the pressing projection portion 311 of the lid portion 31 comes into contact with the to-be-pressed surface of the elastic member 37. The pressing surface of the pressing projection portion 311 faces the mounting surface 331*a*. At this time, an opening end on the front side of the housing 33 does not come into contact with the rear surface of the lid portion 31.

Next, the lid portion 31 is pressed against the housing 33 by an operator, etc. At this time, the elastic member 37 is pressed against the attaching portion 343 of the diaphragm 34 by the pressing projection portion 311 of the lid portion 31 (pressing process). At this time, the opening end on the front side of the housing 33 comes into contact with the rear surface of the lid portion 31, and the opening on the front side of the housing 33 is covered by the lid portion 31.

Figure 9:
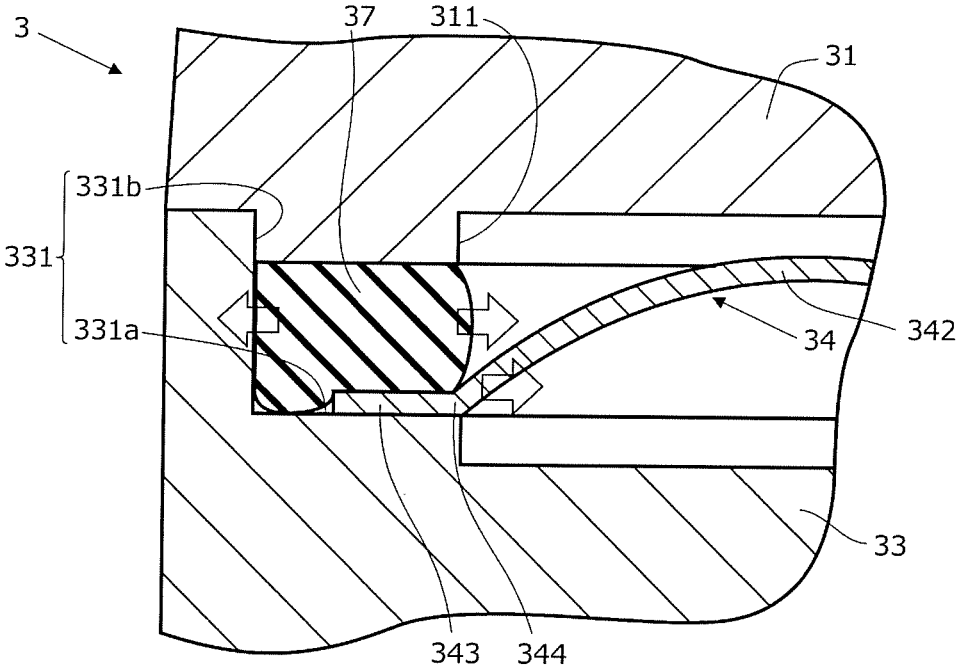
FIG. 9 is a partial enlarged sectional view of the electroacoustic transducer, describing a pressing process in the embodiment of the method of manufacturing an electroacoustic transducer according to the present invention.

FIG. 9 is a partial enlarged sectional view of the electroacoustic transducer 3, showing a state where the elastic member 37 presses the attaching portion 343 through the pressing process.

The outer circumference of the elastic member 37 stretches to the wall surface 331*b* of the stepped portion 331, that is, deforms toward the wall surface 331*b*, and comes into contact with the wall surface 331*b*. The inner circumference of the elastic member 37 stretches to the border 344 between the sub dome 342 (dome portion) and the attaching portion 343 of the diaphragm 34, and comes into contact with the border 344. That is, the inner circumference of the elastic member 37 deforms toward the border 344 and comes into contact with the border 344. That is, the whole of the inner circumference of the elastic member 37 is positioned at the border 344. At this time, the dome portion of the diaphragm 34 is pressed toward the central side in the radial direction of the housing 33 from all radial directions of the diaphragm 34 by the elastic member 37. Therefore, in a direction (the horizontal direction of the paper of FIG. 9) orthogonal to the front-rear direction (the vertical direction of the paper of FIG. 9), the center of the diaphragm 34 is positioned at the center of the housing 33. As a result, as shown in FIG. 5, the voice coil 35 is disposed in the magnetic gap G of the magnetic circuit 36 without making contact with the center pole 363 and the ring yoke 364. In addition, the border 344 is positioned at an inner circumferential end of the mounting surface 331*a* and pressed against the mounting surface 331*a* by the elastic member 37.

Thus, by sandwiching the attaching portion 343 by the elastic member 37 and the mounting surface 331*a*, the diaphragm 34 is fixed to the housing 33. At this time, the inner circumference of the elastic member 37 is positioned at the border 344 of the diaphragm 34, and accordingly, vibration of the border 344 is suppressed.

It is only required that at least a portion of the inner circumference of the elastic member is positioned at the border between the sub dome and the attaching portion, and at least a portion of the outer circumference of the elastic member comes into contact with the wall surface. That is, for example, as long as vibration of the border is restrained, only a portion of the inner circumference of the elastic member may be positioned at the border.

The lid portion 31 is fixed to the housing 33 in a state where the lid portion is pressed against the housing 33 by, for example, a tape, an adhesive agent, or the like. The lead wire 351 of the voice coil 35 is electrically connected to the electrode portion 333 of the housing 33 by solder, etc. The lid portion 31 functions as, for example, a resonator.

Thus, the present method consists of the first mounting process, the second mounting process, and the pressing process, and the diaphragm 34 is positioned by pressing the elastic member 37, and unnecessary vibration of the border 344 is suppressed by positioning the inner circumference of the elastic member 37 at the border 344 of the diaphragm 34.

Operation of Electroacoustic Transducer (1)

Next, operation of the electroacoustic transducer 3 is described.

A sound wave from a sound source enters the inside of the housing 33 from the front sound holes 31*h* of the lid portion 31 and reaches the front surface of the diaphragm 34, and enters the inside of the housing 33 from the rear sound holes 33*h* of the housing 33 and reaches the rear surface of the diaphragm 34. When the sound wave from the sound source reaches the diaphragm 34, the vibrating portion (dome portion) of the diaphragm 34 vibrates in the front-rear direction. At this time, along with the vibration of the vibrating portion, the voice coil 35 vibrates in the front-rear direction, that is, a direction crossing a magnetic flux of a magnetic field of the magnetic circuit 36 inside the magnetic gap G. As a result, in the voice coil 35, an electric current (electric signal) corresponding to the sound wave is generated.

When the vibrating portion vibrates, the vibrating portion generates a traveling wave traveling from the vibrating portion toward the attaching portion 343. As described above, the attaching portion 343 is sandwiched by the mounting surface 331*a* and the elastic member 37. The traveling wave reaches the elastic member 37 and the mounting surface 331*a*. The traveling wave that has reached the mounting surface 331*a* is reflected by the mounting surface 331*a* and becomes a reflected wave. On the other hand, the traveling wave that has reached the elastic member 37 is absorbed by the elastic member 37. That is, the elastic member 37 hardly generates a reflected wave. That is, the electroacoustic transducer according to the present invention suppresses generation of a reflected wave as compared with a conventional electroacoustic transducer including a diaphragm fixed to a housing by an adhesive agent or the like.

The elastic member 37 is positioned at the border 344 of the diaphragm 34. That is, the border 344 is sandwiched by the elastic member 37 and the mounting surface 331*a*. Therefore, when the vibrating portion vibrates, the border 344 does not vibrate. As a result, the diaphragm 34 (attaching portion 343) and the mounting surface 331*a* do not collide with each other, and the frequency characteristics of the electroacoustic transducer 3 become stable.

Conclusion

In the electroacoustic transducer according to the embodiment described above, when the lid portion 31 presses the elastic member 37 against the attaching portion 343, the outer circumference of the elastic member 37 stretches to the wall surface 331*b* of the stepped portion 331 and comes into contact with the wall surface 331*b*. The inner circumference of the elastic member 37 stretches to the border 344 of the diaphragm 34 and comes into contact with the border 344. Therefore, in a direction orthogonal to the front-rear direction, the center of the diaphragm 34 is positioned at the center of the housing 33.

In addition, the attaching portion 343 is sandwiched by the mounting surface 331*a* and the elastic member 37. Therefore, a traveling wave from the vibrating portion is absorbed by the elastic member 37. That is, the electroacoustic transducer according to the present invention suppresses generation of a reflected wave as compared with a conventional electroacoustic transducer including a diaphragm fixed to a housing by an adhesive agent or the like. As a result, the electroacoustic transducer according to the present invention suppresses deterioration and variation in frequency characteristics due to a reflected wave.

Further, by sandwiching the attaching portion 343 by the elastic member 37 and the mounting surface 331*a*, the diaphragm 34 is fixed to the housing 33. At this time, the inner circumference of the elastic member 37 is positioned at the border 344 of the diaphragm 34, so that vibration of the border 344 is suppressed. As a result, the electroacoustic transducer according to the present invention suppresses deterioration and variation in frequency characteristics due to vibration of the border 344.

Furthermore, the lid portion 31 includes a pressing projection portion 311. Therefore, the thickness of the elastic member 37 becomes thinner in accordance with an amount of projection of the pressing projection portion 311. As a result, the elastic member 37 easily deforms. That is, the inner circumference of the elastic member 37 easily stretches to the border 344 of the diaphragm 34. As a result, vibration of the border 344 is suppressed. That is, the electroacoustic transducer according to the present invention suppresses deterioration and variation in frequency characteristics.

In the electroacoustic transducer according to the embodiment described above, the electroacoustic transducer 3 is an electroacoustic transducer that converts a sound wave into an electric signal. Instead of this, the electroacoustic transducer may be an electroacoustic transducer that converts an electric signal into a sound wave. That is, for example, the electroacoustic transducer according to the present invention may be a dynamic-type driver unit that converts an electric signal into a sound wave. That is, for example, the electroacoustic transducing device according to the present invention may be a headphone, an earphone, or a speaker. In this case, the diaphragm generates a sound wave by vibrating in response to an electric signal flowing in the voice coil.

Furthermore, the lid portion need not be included the pressing projection portion. That is, for example, the rear surface of the bottom portion of the lid portion may be planar. In this case, in the front-rear direction, the thickness of the elastic member is larger than the length of the wall surface. The pressing surface is, in the bottom portion of the lid portion, a portion that comes into contact with the elastic member.

An amount of projection of the inner circumference of the pressing projection portion may be smaller than an amount of projection of the outer circumference of the pressing projection portion. That is, for example, the contact surface of the pressing projection portion with the elastic member may be tapered shape so that its amount of projection continuously decreases from the outer circumference toward the inner circumference. In addition, for example, the contact surface of the pressing projection portion with the elastic member may be stepwise so that its amount of projection decreases in a stepwise fashion from the outer circumference toward the inner circumference.

Figure 10:
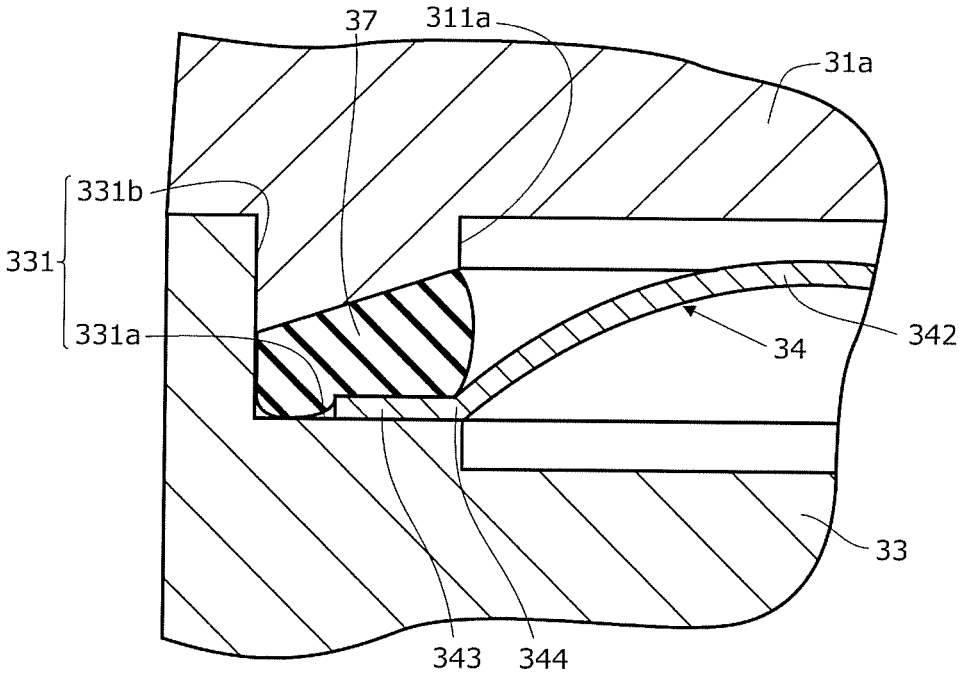
FIG. 10 is a partial enlarged sectional view showing another example of a lid portion of the electroacoustic transducer according to the present invention.

FIG. 10 is a partial enlarged sectional view showing another form of the lid portion.

A lid portion 31*a* includes a pressing projection portion 311*a*. The pressing projection portion 311*a* projects rearward in a ring shape from the bottom portion of the lid portion 31*a*. An amount of projection of the pressing projection portion 311*a* continuously decreases from the outer circumference toward the inner circumference. That is, a contact surface of the pressing projection portion 311*a* with the elastic member 37 is tapered in a sectional view.

Figure 11:
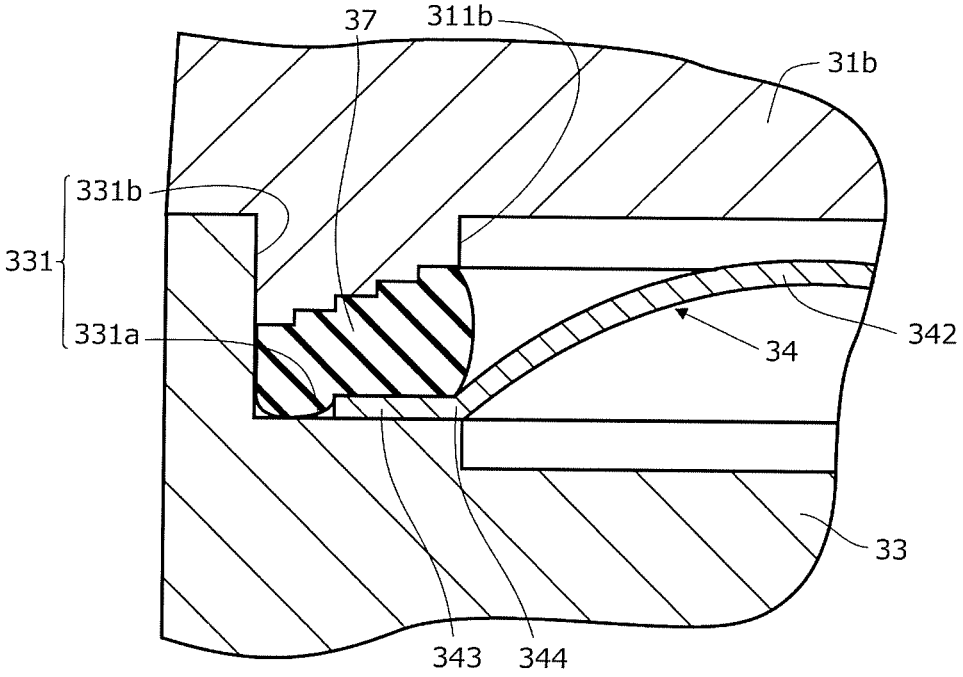
FIG. 11 is a partial enlarged sectional view showing still another example of the lid portion of the electroacoustic transducer according to the present invention.

FIG. 11 is a partial enlarged sectional view showing still another form of the lid portion.

A lid portion 31*b* includes a pressing projection portion 311*b*. The pressing projection portion 311*b* projects rearward in a ring shape from the bottom portion of the lid portion 31*b*. An amount of projection of the pressing projection portion 311*b* decreases in a stepwise fashion from the outer circumference toward the inner circumference. That is, a contact surface of the pressing projection portion 311*b* with the elastic member 37 is stepwise in a sectional view.

As shown in FIG. 10 and FIG. 11, by setting the amount of projection of the inner circumference of the pressing projection portion 311*a*, 311*b* to be smaller than the amount of projection of the outer circumference of the pressing projection portion 311*a*, 311*b*, the inner circumferential portion of the elastic member 37 becomes softer than the outer circumferential portion of the elastic member 37. As a result, the elastic member 37 easily absorbs a traveling wave as compared with a case where the amount of projection of the inner circumference of the pressing projection portion and the amount of projection of the outer circumference are the same (that is, as compared with the pressing projection portion 311). In addition, the elastic member 37 is pressed toward the inner circumferential side by the pressing projection portion 311*a*, 311*b*, so that the positioning accuracy of the diaphragm 34 is improved. Further, a force of the outer circumferential portion of the pressing projection portion 311*a*, 311*b* to press the elastic member 37 against the mounting surface 331*a* becomes stronger than that of the pressing projection portion 311.

Furthermore, the pressing surface of the pressing projection portion and the to-be-pressed surface of the elastic member may be concavo-convex surfaces. In other words, a portion of the pressing surface may come into contact with the elastic member, or a portion of the to-be-pressed surface may come into contact with the lid portion. That is, for example, the to-be-pressed surface may include a rib or groove continuing along the circumferential direction of the elastic member, or a plurality of projection portions or grooves. The pressing surface may include a rib or groove continuing along the circumferential direction of the lid portion, or a plurality of projection portions or grooves.

Figure 12:
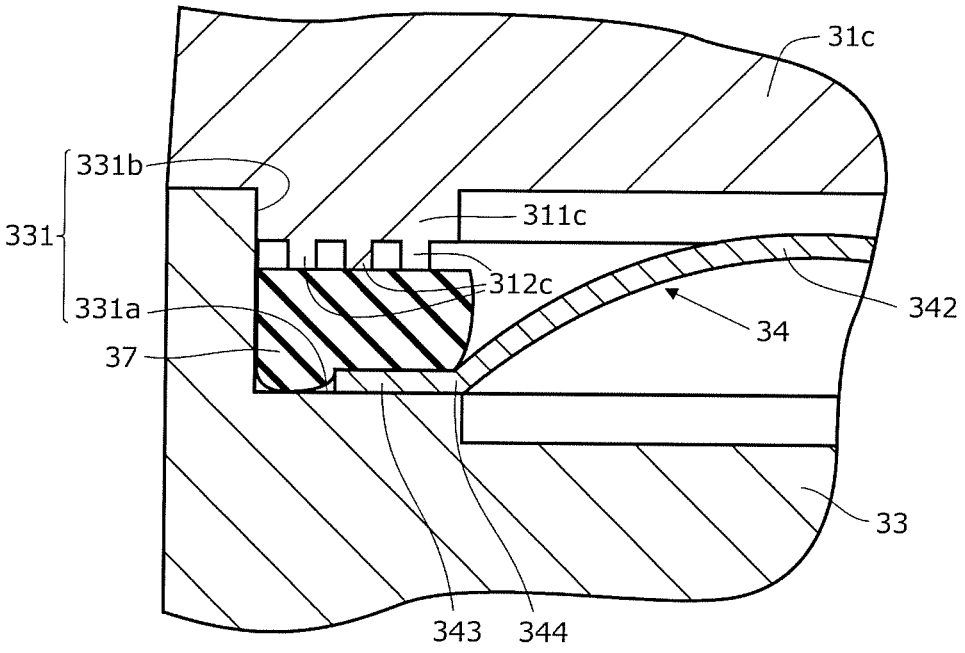
FIG. 12 is a partial enlarged sectional view showing still another example of the lid portion of the electroacoustic transducer according to the present invention.

FIG. 12 is a partial enlarged sectional view showing still another form of the lid portion.

A lid portion 31*c* includes a pressing projection portion 311*c* and three ribs 312*c*. The pressing projection portion 311*c* projects in a ring shape from the bottom portion of the lid portion 31*c*. The ribs 312*c* project in ring shapes along a circumferential direction of the pressing projection portion 311*c* from a pressing surface of the pressing projection portion 311*c*. The ribs 312*c* are disposed concentrically on the pressing surface of the pressing projection portion 311*c*. Contact surfaces of the ribs 312*c* with the elastic member 37 constitute portions of the pressing surface of the pressing projection portion 311*c*. That is, portions of the pressing surface of the pressing projection portion 311*c* come into contact with the elastic member 37 via the ribs 312*c* and press the elastic member 37.

The number of ribs is not limited to "3." The lid portion may include a plurality of projections instead of the ring-shaped ribs. In this case, the projections are disposed on the pressing surface evenly in the circumferential direction of the pressing projection portion. Further, instead of the ribs or projection portions, the lid portion may include a groove continuing in a ring shape, or a plurality of grooves intermissive in a ring shape.

Figure 13:
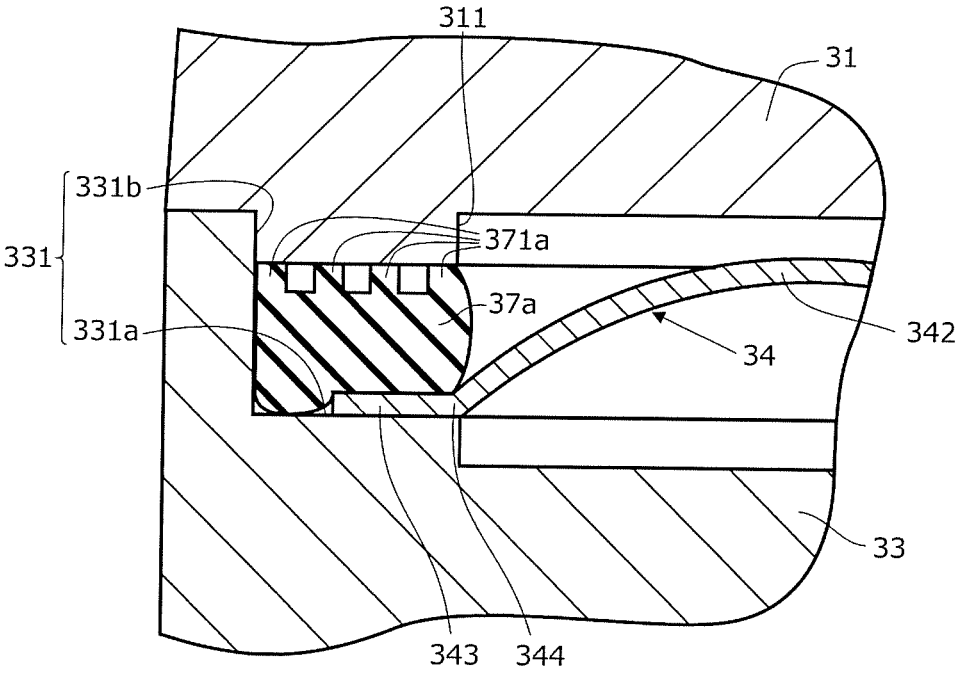
FIG. 13 is a partial enlarged sectional view showing another example of an elastic member of the electroacoustic transducer according to the present invention.

FIG. 13 is a partial enlarged sectional view showing another form of the elastic member.

An elastic member 37*a* has four ribs 371*a*. The ribs 371*a* project in ring shapes along a circumferential direction of the elastic member 37*a* from the to-be-pressed surface of the elastic member 37*a*. The ribs 371*a* are disposed concentrically on the to-be-pressed surface of the elastic member 37*a*. Contact surfaces of the ribs 371*a* with the pressing projection portion 311 constitute portions of the to-be-pressed surface of the elastic member 37*a*. That is, portions of the to-be-pressed surface of the elastic member 37*a* come into contact with the pressing projection portion 311 via the ribs 371*a* and are pressed by the pressing projection portion 311.

The number of ribs is not limited to "four." The elastic member may include a plurality of projections instead of the ring-shaped ribs. In this case, the projections are disposed on the to-be-pressed surface evenly in the circumferential direction of the elastic member.

Figure 14:
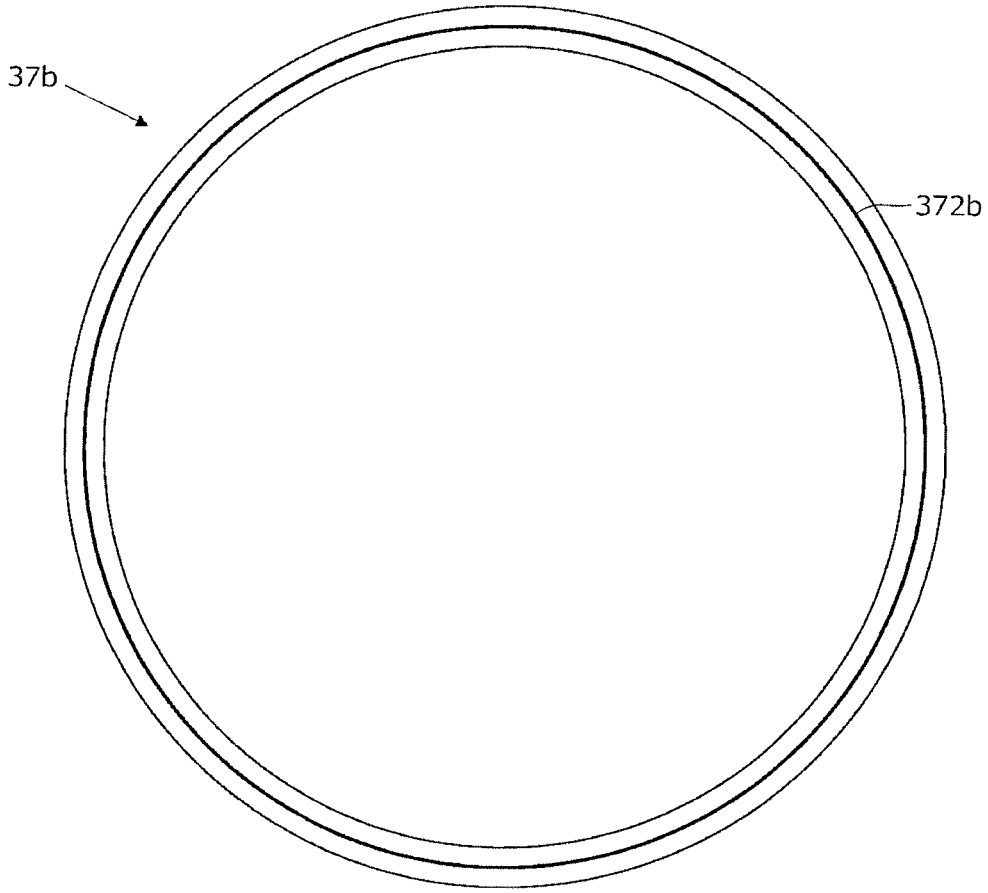
FIG. 14 is a plan view showing still another example of the elastic member of the electroacoustic transducer according to the present invention.

FIG. 14 is a plan view showing still another form of the elastic member.

An elastic member 37*b* include a ring-shaped groove 372*b*. The groove 372*b* is disposed along a circumferential direction of the elastic member 37*b* on a to-be-pressed surface of the elastic member 37*b*.

The ring-shaped groove may be plurally disposed concentrically on the to-be-pressed surface of the elastic member.

Figure 15:
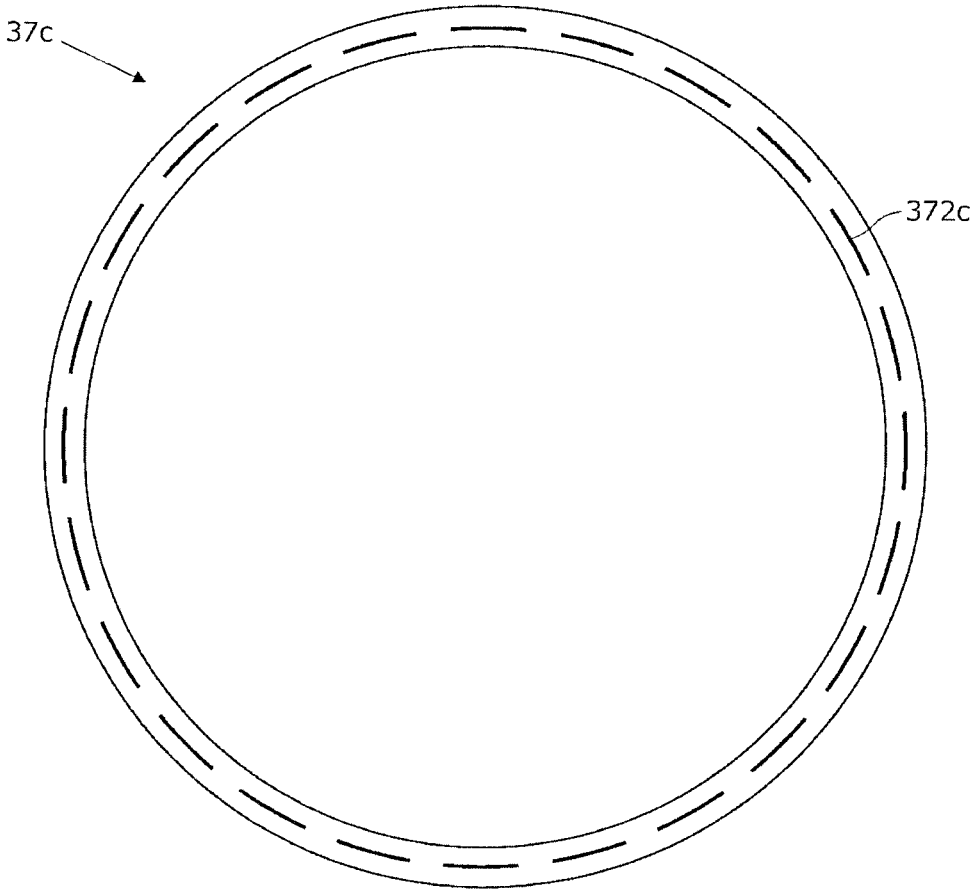
FIG. 15 is a plan view showing still another example of the elastic member of the electroacoustic transducer according to the present invention.

FIG. 15 is a plan view showing still another form of the elastic member.

An elastic member 37*c* has a plurality of grooves 372*c*. The plurality of grooves 372*c* are disposed on a to-be-pressed surface of the elastic member 37*c* evenly along a circumferential direction of the elastic member 37*c*. That is, the grooves 372*c* are in an intermissive ring shape.

As the grooves forming an intermissive ring shape, grooves forming a plurality of intermissive ring shapes may be disposed concentrically on the to-be-pressed surface of the elastic member.

A traveling wave from the vibrating portion which propagated to the elastic member 37 may not be completely absorbed by the elastic member 37 and may reach the lid portion 31. In this case, the traveling wave is reflected by the lid portion 31 and becomes a reflected wave. However, as shown in FIG. 12 to FIG. 15, when either the pressing surface or the to-be-pressed surface is a concavo-convex surface, a contact area between the lid portion 31 (31*a*-31*c*) and the elastic member 37 (37*a*, 37*b*) decreases. Therefore, generation of a reflected wave by the lid portion 31 (31*a*-31*c*) is suppressed.

Furthermore, the shape of the elastic member is not limited to that shown in the present embodiment. That is, for example, the shape of the elastic member may be circular, oval, or trapezoid, etc., in a sectional view. The elastic member may include a projection portion that projects on the inner circumferential side or the outer circumferential side of the elastic member.

Figure 16:
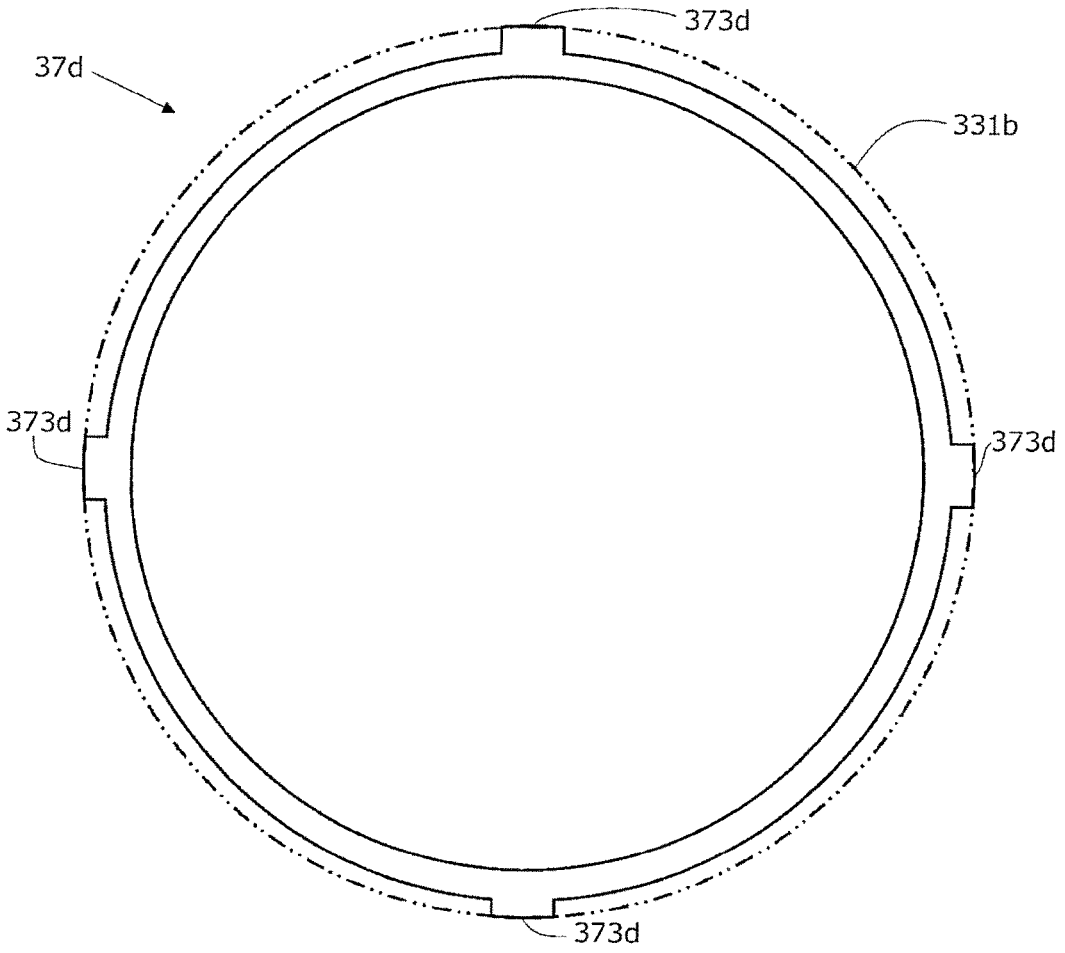
FIG. 16 is a plan view showing still another example of the elastic member of the electroacoustic transducer according to the present invention.

FIG. 16 is a plan view showing still another form of the elastic member.

An elastic member 37*d* includes four projection portions 373*d* projecting at even intervals from an outer circumference of the elastic member 37*d*. The projection portions 373*d* constitute portions of the outer circumference of the elastic member 37*d*. At least portions of the outer circumferences of the projection portions 373*d* come into contact with the wall surface 331*b*. A traveling wave from the vibrating portion which propagated to the elastic member 37*d* may not be completely absorbed by the elastic member 37*d* and may reach the wall surface 331*b*. In this case, the traveling wave is reflected by the wall surface 331*b* and becomes a reflected wave. However, contact points between the elastic member 37*d* and the wall surface 331*b* are less than contact points between the elastic member 37 and the wall surface 331*b*. Therefore, generation of a reflected wave by the wall surface 331*b* is suppressed.

Figure 17:
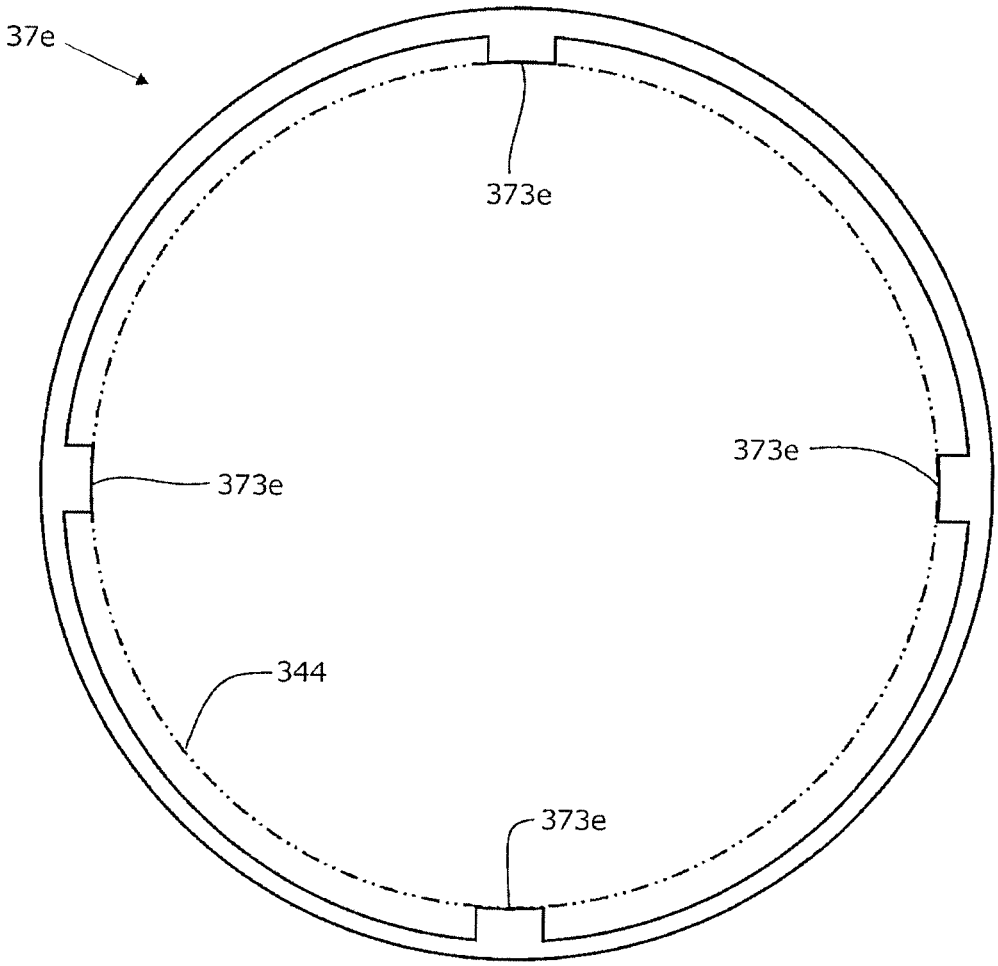
FIG. 17 is a plan view showing still another example of the elastic member of the electroacoustic transducer according to the present invention.

FIG. 17 is a plan view showing still another form of the elastic member.

An elastic member 37*e* includes four projection portions 373*e* projecting at even intervals from an inner circumference of the elastic member 37*e*. The projection portions 373*e* constitute portions of the inner circumference of the elastic member 37*e*. At least portions of the inner circumferences of the projection portions 373*e* are positioned at the border 344 of the diaphragm 34. In this case, as compared with the elastic member 37 that includes no projection portions, the number of points (regions) positioned at the border 344 is smaller. Therefore, variation in position to press the border 344 among products (electroacoustic transducers) is suppressed.

Electroacoustic Transducer (2)

Next, another embodiment (hereinafter, referred to as "second embodiment") of the electroacoustic transducer according to the present invention is described by focusing on a difference from the embodiment described above (hereinafter, referred to as "first embodiment"). The electroacoustic transducer according to the second embodiment is different in the lid portion from the first embodiment.

Configuration of Electroacoustic Transducer (2)

Figure 18:
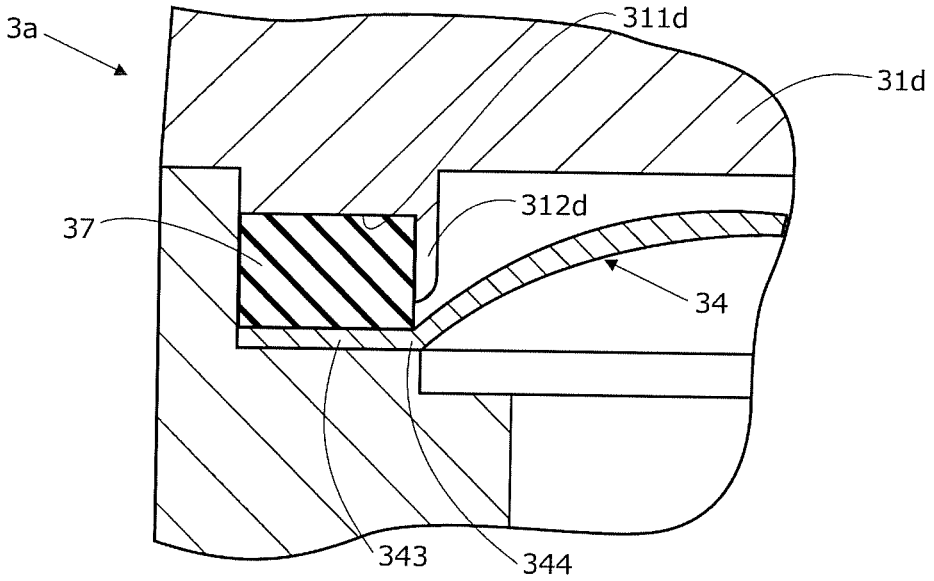
FIG. 18 is a partial enlarged sectional view showing another embodiment of the electroacoustic transducer according to the present invention.

FIG. 18 is a partial enlarged sectional view showing another embodiment of the electroacoustic transducer according to the present invention.

An electroacoustic transducer 3*a* includes a lid portion 31*d*.

The lid portion 31*d* has the same function as that of the lid portion 31 of the first embodiment. That is, the lid portion 31*d* is another example of the pressing member in the present invention. The lid portion 31*d* includes a pressing projection portion 311*d* and a restricting portion 312*d*. The pressing projection portion 311*d* presses the elastic member 37, same as the pressing projection portion 311 of the first embodiment.

The restricting portion 312*d* restricts stretching of the inner circumference of the elastic member 37 to the vibrating portion of the diaphragm 34. The restricting portion 312*d* is configured by projecting a portion of the bottom portion of the lid portion 31*d* rearward in a cylindrical shape. The restricting portion 312*d* is disposed at an inner rim of the pressing projection portion 311*d*. The restricting portion 312*d* is integral with the pressing projection portion 311*d* of the lid portion 31*d*. An amount of projection of the restricting portion 312*d* is larger than an amount of projection of the pressing projection portion 311*d*. An outer diameter of the restricting portion 312*d* is the same as a diameter of the border 344 of the diaphragm 34.

When the lid portion 31*d* presses the elastic member 37, a portion of the inner circumference of the elastic member 37 comes into contact with the restricting portion 312*d*. As a result, the inner circumference of the elastic member 37 does not stretch inward beyond the border 344. Therefore, the elastic member 37 does not block vibration of the vibrating portion.

Conclusion

In the electroacoustic transducer according to the embodiment described above, the lid portion 31*d* includes the restricting portion 312*d* with which the inner circumference of the elastic member 37 comes into contact. As a result, the inner circumference of the elastic member 37 does not stretch inward beyond the border 344. Therefore, the elastic member 37 does not block vibration of the vibrating portion. That is, when the diaphragm 34 vibrates, the elastic member 37 suppresses vibration of the border 344 without blocking vibration of the vibrating portion. As a result, in the electroacoustic transducer according to the present invention, deterioration and variation in frequency characteristics are suppressed.

Electroacoustic Transducer (3)

Next, still another embodiment (hereinafter, referred to as "third embodiment") of the electroacoustic transducer according to the present invention is described by focusing on a difference from the first embodiment and the second embodiment described above. An electroacoustic transducer according to the third embodiment is different in the attaching portion of the diaphragm from the first embodiment and the second embodiment.

Configuration of Electroacoustic Transducer (3)

Figure 19:
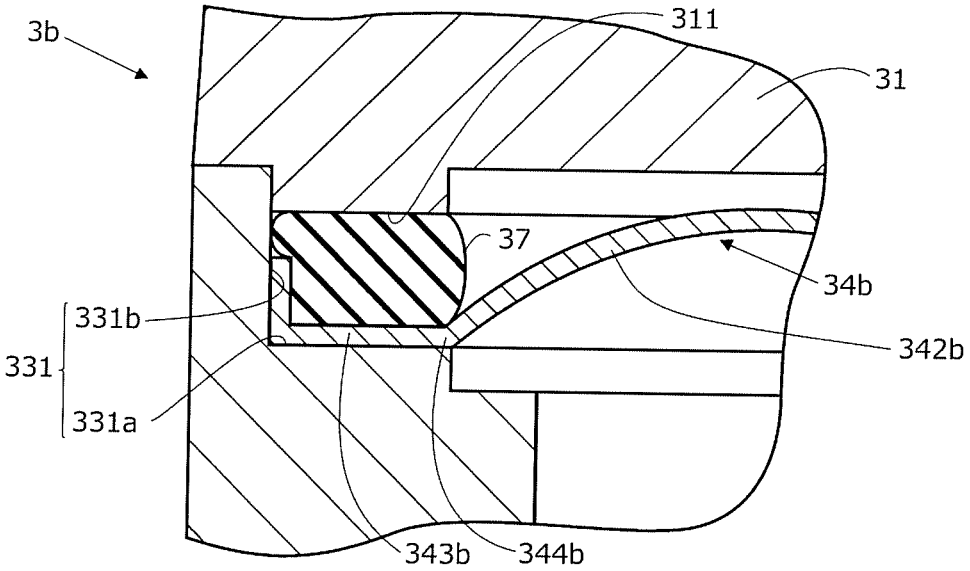
FIG. 19 is a partial enlarged sectional view showing still another embodiment of the electroacoustic transducer according to the present invention.

FIG. 19 is a partial enlarged sectional view showing still another embodiment of the electroacoustic transducer according to the present invention.

An electroacoustic transducer 3*b* includes a diaphragm 34*b*.

The diaphragm 34*b* has the same function as that of the diaphragm 34 of the first embodiment. The diaphragm 34*b* includes a main dome (not shown), a sub dome 342*b*, an attaching portion 343*b*, and a border 344*b*. An outer circumferential portion of the attaching portion 343*b* is bent forward into an L shape in a sectional view. That is, the attaching portion 343*b* has a ring shape in a planar view, and an L shape in a sectional view.

In the pressing process, the attaching portion 343*b* of the diaphragm 34*b* is pressed against the mounting surface 331*a* and the wall surface 331*b* by the elastic member 37. That is, the attaching portion 343*b* is pressed in the front-rear direction and a direction orthogonal to the front-rear direction by the elastic member 37. As a result, the diaphragm 34*b* is more securely fixed to the housing 33 as compared with the diaphragm 34 in the first embodiment and the second embodiment.

Conclusion

In the electroacoustic transducer according to the embodiment described above, the diaphragm 34*b* is more securely fixed to the housing 33 as compared with the diaphragm 34 in the first embodiment and the second embodiment. As a result, vibration of the border 344*b* of the diaphragm 34*b* is further suppressed. That is, in the electroacoustic transducer according to the present invention, deterioration and variation in frequency characteristics are suppressed.

The invention claimed is:

1. An electroacoustic transducer comprising:
a diaphragm;
a housing accommodating the diaphragm;
an elastic member being accommodated in the housing; and
a pressing member pressing the elastic member, wherein
the elastic member is annular,
the diaphragm comprises
a dome portion, and
an attaching portion disposed on an outer rim of the dome portion,
the housing comprises
a stepped portion,
the stepped portion comprises
a mounting surface on which the attaching portion is mounted, and
a wall surface extending in a direction separating from the mounting surface,
the elastic member has
an inner circumference,
an outer circumference, and
a rear surface having an inner circumferential end,
the pressing member presses the elastic member against the attaching portion,
the outer circumference of the elastic member stretches to the wall surface,
the inner circumference of the elastic member stretches to a border between the dome portion and the attaching portion, and
the inner circumferential end is positioned at the border between the dome portion and the attaching portion.

2. The electroacoustic transducer according to claim 1, wherein
at least a portion of the outer circumference of the elastic member comes into contact with the wall surface, and
at least a portion of the inner circumference of the elastic member is positioned at a border between the dome portion and the attaching portion.

3. The electroacoustic transducer according to claim 1, wherein
the pressing member includes
a restricting portion, and
at least a portion of the inner circumference of the elastic member comes into contact with the restricting portion.

4. The electroacoustic transducer according to claim 1, wherein
the elastic member includes
a projection portion, and
at least a portion of an outer circumference of the projection portion comes into contact with the wall surface.

5. The electroacoustic transducer according to claim 1, wherein
the elastic member includes
a projection portion, and
at least a portion of an inner circumference of the projection portion is positioned at the border.

6. The electroacoustic transducer according to claim 1, wherein
the pressing member includes
a pressing projection portion, and
the pressing projection portion presses the elastic member.

7. The electroacoustic transducer according to claim 6, wherein
the pressing projection portion is annular, and
an amount of projection of an inner circumference of the pressing projection portion is smaller than an amount of projection of an outer circumference of the pressing projection portion.

8. The electroacoustic transducer according to claim 1, wherein
the elastic member includes
a to-be-pressed surface is pressed by the pressing member, and a portion of the to-be-pressed surface comes into contact with the pressing member.

9. The electroacoustic transducer according to claim 1, wherein the pressing member includes a pressing surface presses the elastic member, and a portion of the pressing surface comes into contact with the elastic member.

10. An electroacoustic transducing device comprising:

an electroacoustic transducer, wherein the electroacoustic transducer is the electroacoustic transducer according to claim 1.

11. A method of manufacturing an electroacoustic transducer, the electroacoustic transducer comprises:

a diaphragm vibrates based on a sound wave, a housing accommodates the diaphragm, an annular elastic member is accommodated in the housing, and a pressing member presses the elastic member, the diaphragm comprises a dome portion, and an attaching portion disposed on an outer rim of the dome portion, the housing comprises a stepped portion, the stepped portion comprises a mounting surface on which the attaching portion is mounted, and a wall surface extending in a direction separating from the mounting surface, the elastic member has an inner circumference, an outer circumference, and a rear surface having an inner circumferential end, the method of manufacturing an electroacoustic transducer comprising:

a first mounting process in which the attaching portion is mounted on the mounting surface;

a second mounting process in which the elastic member is mounted on the attaching portion;

a pressing process in which the elastic member is pressed by the pressing member, wherein in the pressing process, the outer circumference of the elastic member stretches to the wall surface, and the inner circumference of the elastic member stretches to a border between the dome portion and the attaching portion, and the inner circumferential end is positioned at the border between the dome portion and the attaching portion.

12. The method of manufacturing an electroacoustic transducer according to claim 11, wherein in the pressing process, at least a portion of an outer circumference of the elastic member comes into contact with the wall surface, and at least a portion of an inner circumference of the elastic member is positioned at a border between the dome portion and the attaching portion.

13. The method of manufacturing an electroacoustic transducer according to claim 12, wherein the mounting surface is annular, and in the pressing process, a border between the dome portion and the attaching portion is positioned at an inner circumferential end of the mounting surface.

14. The electroacoustic transducer according to claim 1, wherein the attaching portion has a ring shape, the stepped portion has a ring shape, the attaching portion has an outer diameter which is smaller than an inner diameter of the wall surface, and the elastic member comes into contact with the mounting surface of the stepped portion.

15. The electroacoustic transducer according to claim 1, wherein the rear surface comes into contact with the mounting surface and the wall surface of the stepped portion.

* * * * *